US006508690B2

(12) United States Patent
Axelrad

(10) Patent No.: US 6,508,690 B2
(45) Date of Patent: Jan. 21, 2003

(54) TOY CONSTRUCTION ELEMENT

(76) Inventor: Boaz Axelrad, 34 Khedive Avenue, Toronto (CA), M6B 2G2

( * ) Notice: Subject to any disclaimer, the term of this patent is extended or adjusted under 35 U.S.C. 154(b) by 0 days.

(21) Appl. No.: 09/853,205

(22) Filed: May 11, 2001

(65) Prior Publication Data

US 2002/0168916 A1 Nov. 14, 2002

(51) Int. Cl.[7] ..... A63H 33/08
(52) U.S. Cl. ..... 446/108; 446/121; 446/124
(58) Field of Search ..... 446/108, 109, 446/111, 128, 120, 121, 105, 124, 125, 85

(56) References Cited

U.S. PATENT DOCUMENTS 3,895,456 A * 7/1975 Fabre ..... 428/178
3,940,142 A * 2/1976 Hinz et al. ..... 273/145 C
4,407,898 A * 10/1983 Kato et al. ..... 206/453
4,509,930 A * 4/1985 Schweigert et al. ..... 220/4.29
4,685,892 A * 8/1987 Gould et al. ..... 446/109
4,731,041 A 3/1988 Zeigler ..... 446/115
4,874,341 A 10/1989 Zeigler ..... 446/109
4,968,040 A * 11/1990 McElhaney ..... 273/290

* cited by examiner

*Primary Examiner*—Jacob K. Ackun
(74) *Attorney, Agent, or Firm*—Senniger, Powers, Leavitt & Roedel

(57) ABSTRACT

A toy construction element having a square body where the square body is composed of four triangular sections. Attached to two of the sections are triangular shaped side arms. Sections having side arms attached are indented as compared to the other two sections by an amount equal to one side arm thickness. These toy construction elements are connected by snaps. Snaps are centrally located on the side arms with the complementary snap housings centrally located on raised body sections. A linear hinge separates side arms from the body. Hinges separate sections of the body.

9 Claims, 6 Drawing Sheets

TOY CONSTRUCTION ELEMENT

FIELD OF THE INVENTION

The present invention is related to the field of toy construction elements.

BACKGROUND OF THE INVENTION

Low profile toy construction elements are known that connect to like elements by interlocking fingered edges of the elements. Examples of such toy construction elements can be found in U.S. Pat. Nos. 4,874,341 and 4,731,041. A disadvantage of using such connectors is the difficulty of assembly and possiblity of breakage. A further disadvantage is that the fingers on these elements are very difficult to mold due to very small undercuts on each finger.

U.S. Pat. No. 4,731,041 also employs centrally located face-to-face connectors for the low profile elements. However, the face-to-face connectors of U.S. Pat. No. 4,731,041 merely stack the elements resulting in a limitation on the number of arrangements and a non-elegant assembly.

For the foregoing reasons, there is a need for a low profile toy construction element that does not connect through fingered edges and does not have face-to-face connectors which merely stack the elements.

SUMMARY OF THE INVENTION

Low profile toy construction elements have end and side portions with face-to-face connectors which connect the elements end-to-side while maintaining the low profile of the elements.

Optionally, the low profile toy construction elements have at least one hinge.

Optionally, the toy construction elements are formed of plastic and the face-to-face connectors are snap-fit connectors.

Advantageously, a toy construction element according to a preferred embodiment of the present invention satisfies the need for a number of arrangements on assembly and an elegant assembly.

BRIEF DESCRIPTION OF THE DRAWINGS

These and other features, aspects and advantages of the present invention will become better understood with regard to the following description, appended claims, and accompanying drawings where:

DETAILED DESCRIPTION

Figure 1:
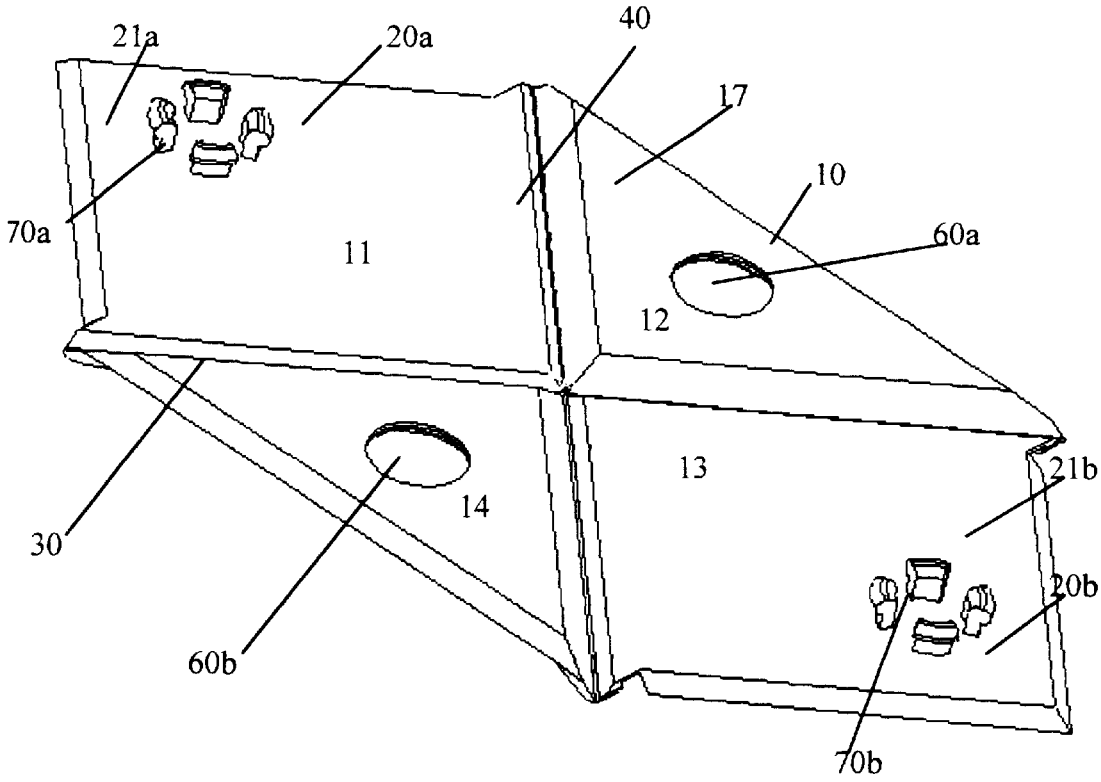
FIG. 1 shows a bottom perspective view of a toy construction element embodying features of the present invention.
Figure 2:
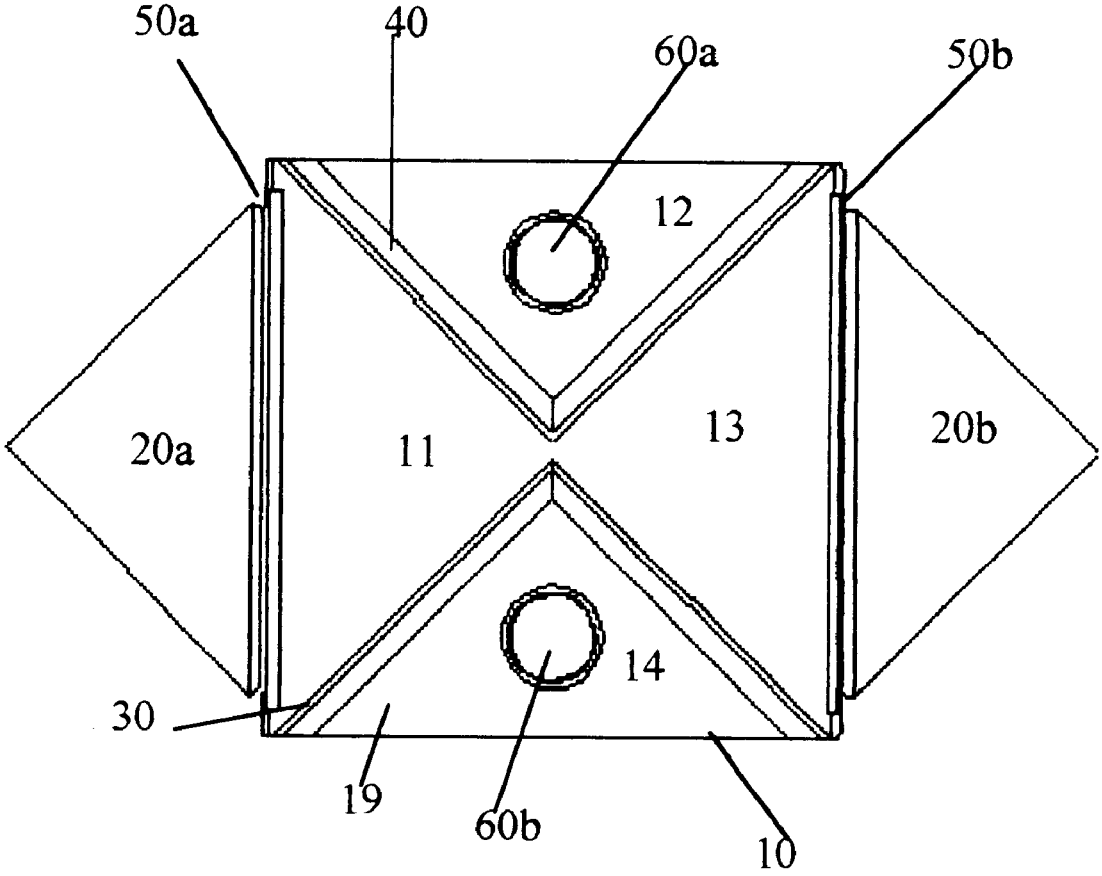
FIG. 2 shows a top plan view of the toy construction element of FIG. 1.
Figure 4:
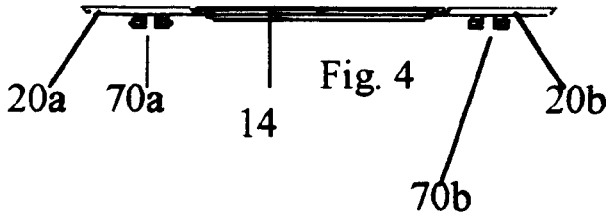
FIG. 4 shows a front elevation view of the toy construction element of FIG. 1.
Figure 3:
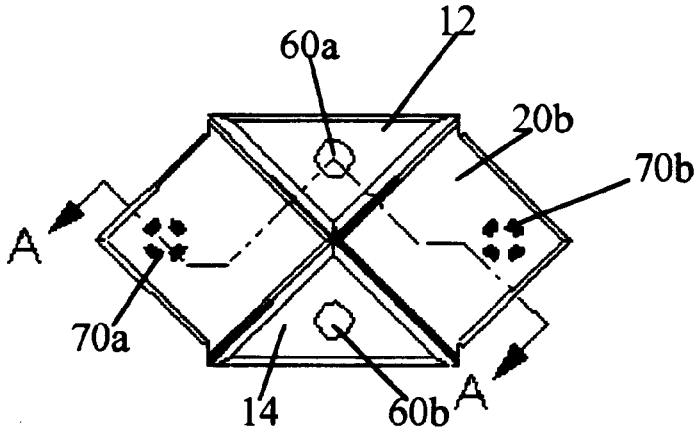
FIG. 3 shows a bottom plan view of the toy construction element of FIG. 1.
Figure 5:
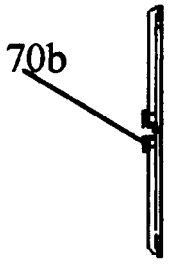
FIG. 5 shows a side elevation view of the toy construction element of FIG. 1.
Figure 6:
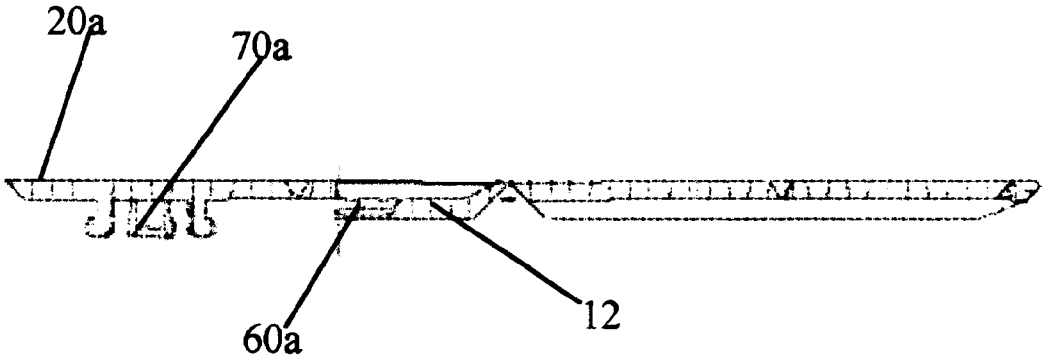
FIG. 6 shows an enlarged sectional view along the lines A—A of FIG. 3.
Figure 7:
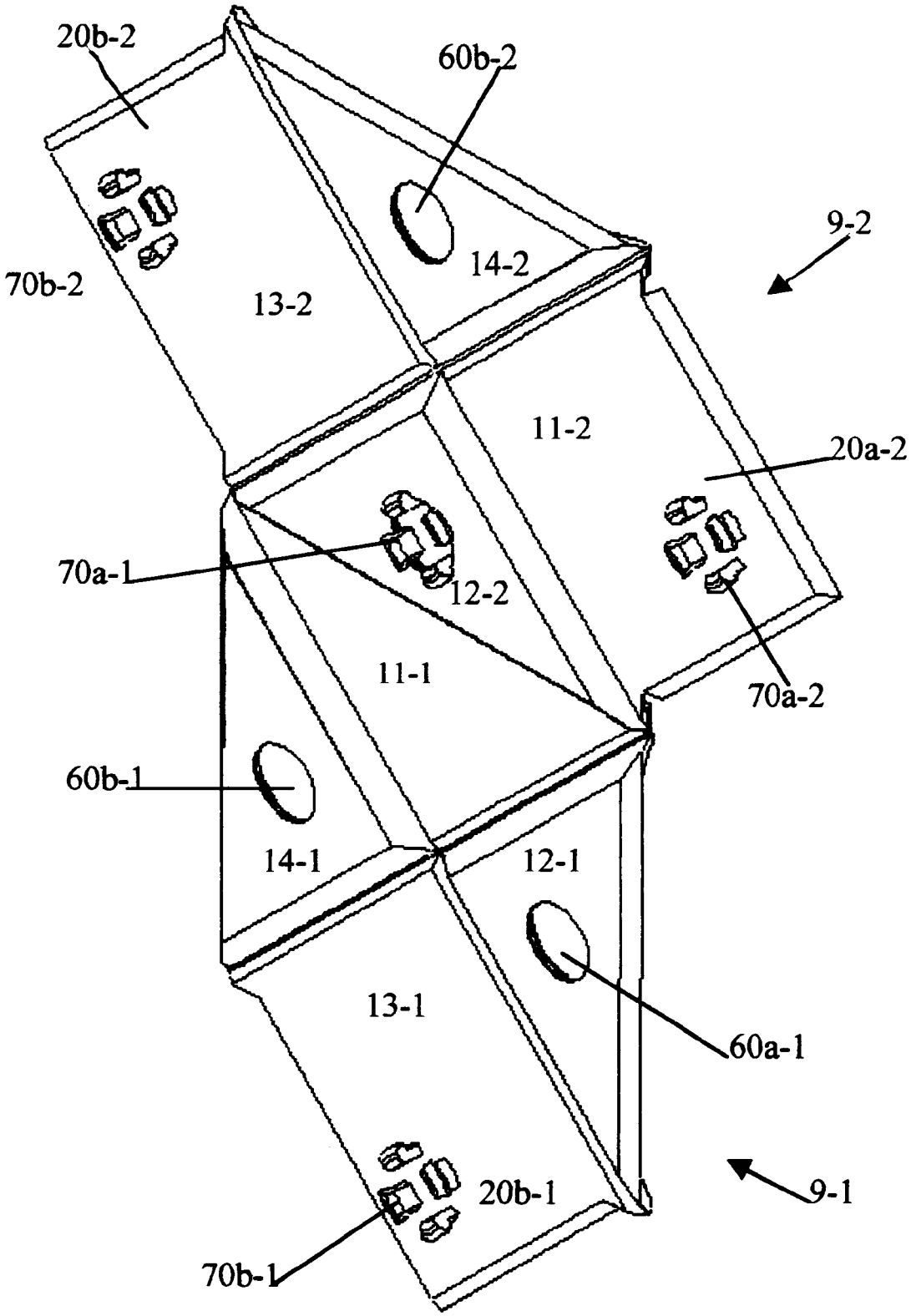
FIG. 7 shows a bottom perspective view of an assembly of two of the toy construction elements of FIG. 1.
Figure 8:
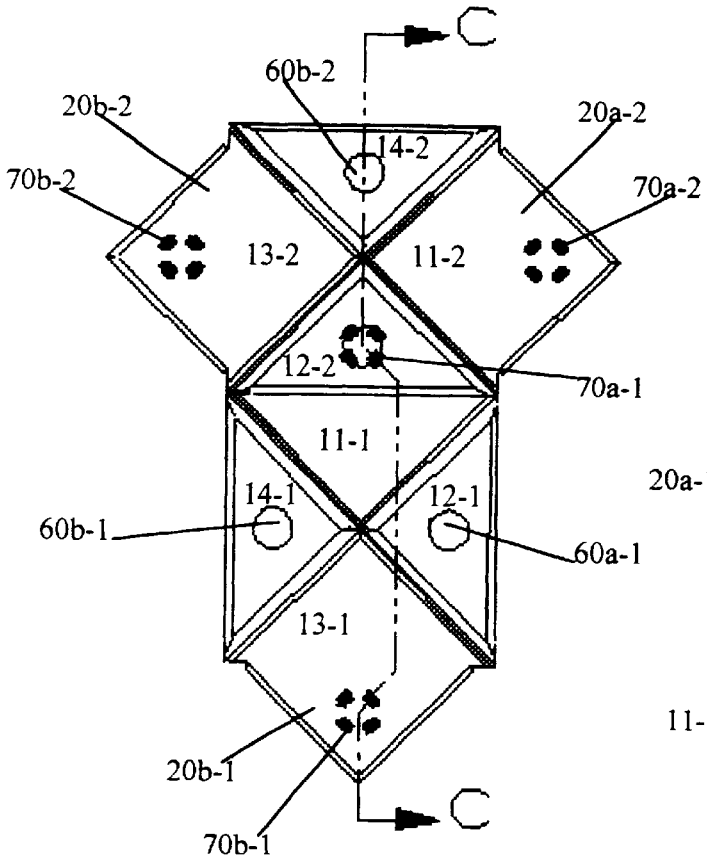
FIG. 8 shows a bottom plan view of the assembly in FIG. 7.
Figure 10:
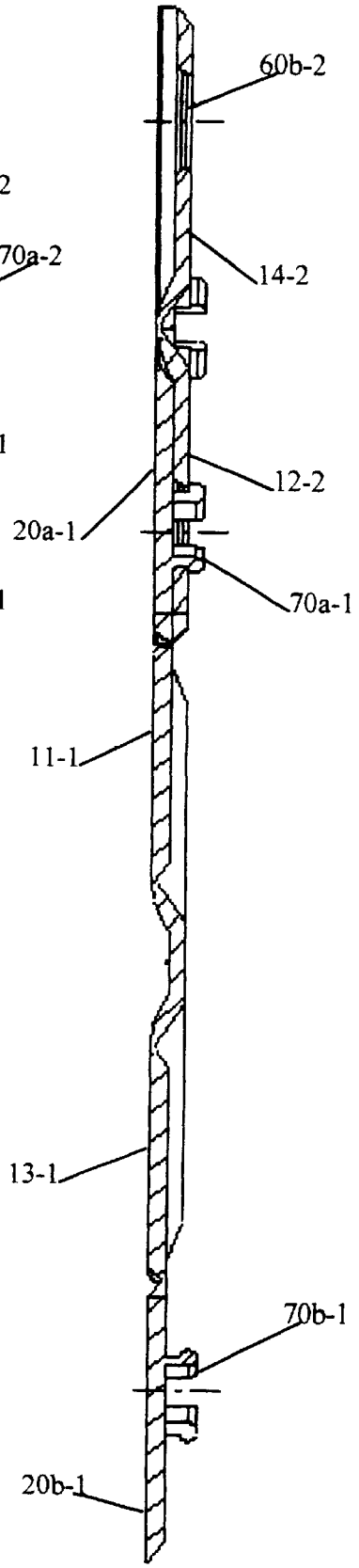
FIG. 10 shows an enlarged sectional view along the lines C—C of FIG. 8.
Figure 9:
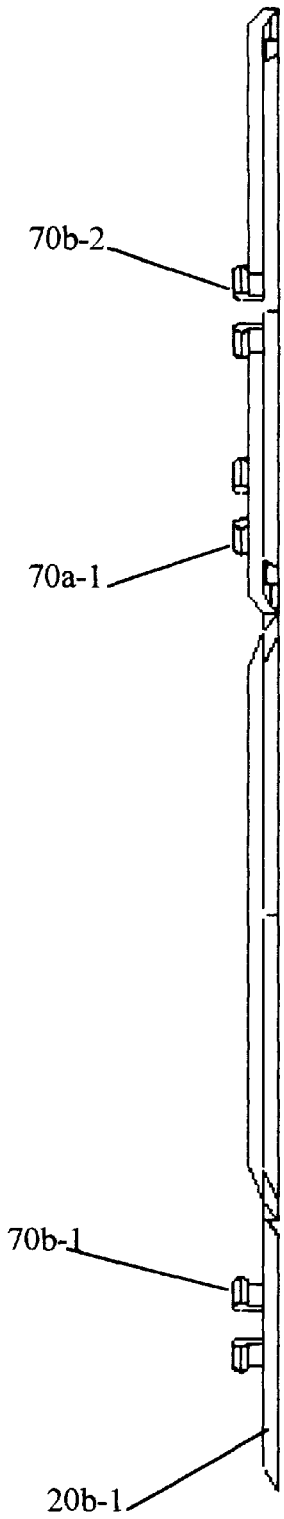
FIG. 9 shows a side elevation view of the assembly in FIG. 7.

As shown in FIGS. 1 to 6, a low profile toy construction element 9 comprises a body 10 and planar side arms 20*a*, 20*b* attached to the body 10. In top view as shown in FIG. 2, the body 10 has a square shaped outline and side arms 20*a*, 20*b* have a triangular outline. Side arms 20*a*, 20*b* are attached to the body 10 at the base of their triangular shape by linear living hinges 50*a*, 50*b*.

With further reference to FIG. 2, living hinges 30, 40 divide the body 10 into four planar triangular sections 11, 12, 13, 14.

The side arms 20*a*, 20*b* and sections 11, 12, 13, 14 are all of the same thickness. Side arms 20*a*, 20*b* are attached to a side edge of, and are in the same plane as, respective sections 11, 13 of body 10. Referencing FIG. 1, sections 11, 13 and side arms 20*a*, 20*b* are indented in relation to sections 12, 14 by an amount equal to one side arm thickness. Thus, the maximum thickness of element 9 is two side arm thicknesses.

Centrally located on body sections 12, 14 are snap housings 60*a*, 60*b*, respectively, which comprise cylindrical bores extending between the lower 17 and upper 19 faces of the body. Centrally located on lower face 21*a*, 21*b* of side arms 20*a*, 20*b* are downwardly directed snaps 70*a*, 70*b* respectively. The snaps 70*a*, 70*b* comprise resilient outwardly flaring plastic segments. The segments are arranged in a ring sized to snap into and out of the cylindrical bores 60*a*, 60*b*. Side arm 20*a* or 20*b* of a first toy construction element can connect to section 12 or 14 of a second toy construction element in a face-to-face fashion in which the connected elements provide a low profile overlap of a side arm of one element with a body portion of another element. Such an assembly of elements is shown in FIGS. 7 to 10, where side arm 20*a*-1 of a first toy construction element 9-1 connects to section 12-2 of a second toy construction element 9-2 in a face-to-face fashion. From FIGS. 9 and 10 it will be apparent that the maximum thickness of the connected elements remains that of two side arm thicknesses. It is also apparent that side arms 20*a*-1, 20*b*-1 have a smaller size than sections 12-1, 14-1 (and 12-2, 14-2) and are therefore sized to nest within sections 12-2, 14-2.

In an alternate arrangement, it may be body sections 12, 14 which are indented with respect to sections 11, 13. In such an arrangement, a second element is flipped upside down before being connected so that the maximum thickness of the connected elements remains at two side arm thicknesses.

Each of linear living hinges 30, 40, 50*a*, 50*b* allow for bending about the hinge up to the point at which contact with the body 10 of the toy construction element, or the assembly of elements, prohibits further bending.

In a preferred embodiment of the invention, the toy construction element is formed of plastic; however, the elements may alternatively be formed of paper, cardboard, wood or a combination thereof. In a preferred embodiment of the invention, connectors are snaps; however, depending on the material used to form the toy construction element, other connectors may preferably be used, such as hook and loop fasteners or hooks.

The previously described embodiment of the present invention has many advantages, including a number of arrangements of elements on assembly. Indeed, a great number of three dimensional shapes may be constructed through low profile face-to-face connection of elements and bending hinges.

A further advantage of the previously described preferred embodiment is a more elegant assembly. Low profile face-to-face connection of elements rather than a stacked connection of elements creates a more aesthetically pleasing assembly of elements.

Although the present invention has been described in considerable detail with reference to a preferred six-sided version thereof, other versions are possible. Alternate embodiments include a body other than square shaped. For instance, triangular, rectangular and other polygonal shaped bodies are included within the scope of the present invention.

Alternate embodiments would also include variation in the shape, number and position of side arms. Side arms need not be limited to a triangular design: half-circular, square or rectangular shaped side arms, or any combination thereof, would also fall within the scope of the present invention. The shaped outline of the side arm, however, is limited to a shaped outline that will still provide low profile face-to-face connection of elements. Toy construction elements may also be constructed with any maximum number of side arms that the polygonal shaped body may accommodate and that still provide low profile face-to-face connection of elements. Side arms may be positioned anywhere around the body.

Alternate embodiments would further include variation in the number of hinges and the bending flexibility of such hinges. The present invention includes toy construction elements having no hinges and toy construction elements having hinges dividing all side arms from the body as well as hinges dividing the body itself into any maximum number of sections that will still provide for low profile face-to-face connection of elements. The present invention further includes a toy construction element having hinges permitting negligible bending to hinges capable of approximately 300° of bending.

Further examples of the present invention would include combinations of the foregoing alternate embodiments. Therefore, the spirit and scope of the appended claims should not be limited to the description of the preferred versions contained herein.

What is claimed is:

1. A toy construction element comprising:

a body having a plurality of sections comprising a first section and an indented second section; at least one side arm attached to the body; and first connector associated with a face of said at least one side arm and a complementary second connector associated with a face of the body such that a first side arm of a first toy construction element may be fastened face-to-face to a body of a second toy construction element, wherein said first side arm is attached to a side edge of one of the first section and the second section, and the second connector associated with the face of the body is associated with another of the first section and the second section.

2. A toy construction element according to claim 1 having at least one hinge.

3. A toy construction element according to claim 1 wherein the indented second section is indented by a thickness of the first side arm.

4. A toy construction element according to claim 1 wherein the first side arm has a smaller size than said one of the first and second sections.

5. A toy construction element according to claim 1 wherein the first connector is a snap associated with the side arm and the second connector is a snap housing associated with the body, wherein the snap housing comprises a bore.

6. A toy construction element according to claim 2 having at least one hinge dividing the body into a plurality of sections.

7. A toy construction element according to claim 1 having a hinge separating the first section from the second section.

8. A toy construction element according to claim 1 having a linear hinge separating the side arm from the body.

9. A toy construction element according to claim 1 formed of plastic.

* * * * *